US009428866B2

(12) United States Patent
Sulesky

(10) Patent No.: US 9,428,866 B2
(45) Date of Patent: Aug. 30, 2016

(54) SEGMENTED RAILWAY REGULATOR BLADE

(71) Applicant: Nordco Inc., Oak Creek, WI (US)

(72) Inventor: William A. Sulesky, Medina, OH (US)

(73) Assignee: NORDCO INC., Oak Creek, WI (US)

( * ) Notice: Subject to any disclaimer, the term of this patent is extended or adjusted under 35 U.S.C. 154(b) by 74 days.

(21) Appl. No.: 14/493,895

(22) Filed: Sep. 23, 2014

(65) Prior Publication Data

US 2016/0083913 A1 Mar. 24, 2016

(51) Int. Cl.

*E01B 27/02* (2006.01)
*E02F 5/22* (2006.01)
*E01H 5/06* (2006.01)

(52) U.S. Cl.

CPC ..... *E01B 27/02* (2013.01); *E02F 5/22* (2013.01); *E01B 2203/02* (2013.01); *E01H 5/061* (2013.01)

(58) Field of Classification Search

CPC ..... E01H 5/06; E01H 5/061; E02F 5/22; E02F 3/8152; E01B 27/02; E01B 2203/02; E01B 27/025

USPC ..... 37/267, 270, 104, 105; 172/701.3

See application file for complete search history.

(56) References Cited

U.S. PATENT DOCUMENTS 2,884,082 A * 4/1959 Osterhaus ..... A01B 15/06 172/719
4,457,380 A * 7/1984 Curry ..... E02F 3/8152 172/701.3
5,396,963 A * 3/1995 Curry ..... E02F 3/8152 172/701.3
5,423,268 A 6/1995 Bounds
5,435,081 A 7/1995 Hannes
5,437,232 A 8/1995 Borowski
5,459,951 A 10/1995 McCray et al.
5,600,903 A 2/1997 McCray
5,657,700 A 8/1997 Bounds
RE36,685 E 5/2000 Bounds
6,408,549 B1 6/2002 Quenzi et al.
6,412,199 B1 7/2002 Quenzi et al.
6,442,877 B1 9/2002 Quenzi et al.
6,450,101 B2 9/2002 Theurer et al.
6,978,718 B2 12/2005 Seyrlehner
7,134,227 B2 11/2006 Quenzi et al.
7,316,084 B2 1/2008 Allen
7,874,085 B1 * 1/2011 Winter ..... E01H 5/061 172/701.3
8,061,063 B2 11/2011 Gamble, II
8,127,471 B2 3/2012 Stevens et al.
8,443,911 B2 * 5/2013 Tutschek ..... A01B 31/00 172/701.3
8,499,477 B2 8/2013 Gamble, II
8,555,786 B2 10/2013 Ganz
8,607,482 B2 12/2013 Bloxdorf
9,163,379 B2 * 10/2015 Winter ..... E01H 5/061

* cited by examiner

*Primary Examiner* — John G Weiss
(74) *Attorney, Agent, or Firm* — Greer, Burns & Crain, Ltd.

(57) ABSTRACT

A blade segment is provided for use on a railway regulator wing, and includes a blade body having a front surface, a top surface, a bottom surface, a first side edge and a second side edge, the blade body having at least one mounting aperture. Each of the first and second side edges having an irregular configuration such that adjacent segments tightly and nestingly engage each other along complementary side edges as they are mounted upon the railway regulator wing.

12 Claims, 3 Drawing Sheets

SEGMENTED RAILWAY REGULATOR BLADE

BACKGROUND

The present invention relates generally to railroad right of way maintenance machinery, and specifically to machinery used for forming and/or shaping rail track ballast in conjunction with railroad track repair, replacement or reconditioning.

Crushed rock rail ballast forms the support bed into which rail ties are inserted for receiving tie plates, spikes or other fasteners, and ultimately rail track. Ballast supports the weight of loaded trains, and also is sufficiently porous to remove standing water from the typically wooden ties. Also, the ballast provides the ability to maintain a constant rail/ground displacement or grading over varying terrain and soil conditions.

During railway maintenance operations, including but not limited to tie replacement, rail replacement or the like, the ballast becomes disrupted and must be reshaped. The optimal shape of rail ballast is a generally level upper surface in which the ties are embedded, and a pair of gradually sloping sides which flare out from ends of the rail ties at a specified angle or angular range which is generally constant across the railroad industry. However, depending on the application and available space, the angle of the ballast may vary.

To achieve the desired angular slope, self-propelled ballast regulators are employed, which feature at least one articulated, fluid-powered arm having at least one blade-like wing attached. Similar in function to a highway snowplow, the wing is oriented at a desired angle and is pushed by the ballast regulator through the ballast as the regulator moves along the track. To maximize the reuse of ballast stones dislodged during the regulation of the ballast, it is typical for a wing to include an outer door to be provided with laterally oriented template doors. The template doors are pivotally connected to side edges of the outer door, and through the use of fluid-powered cylinders, the position of the template doors relative to the outer door can be adjusted to form "C-", "U-" or similarly shaped configurations to retain a supply of disrupted ballast as the regulator moves along the track. In this way, there is sufficient ballast to fill in any depressions encountered to maintain a uniform slope. A suitable arrangement is disclosed in U.S. Pat. No. 6,883,436, incorporated by reference.

In addition, an inner door is positioned generally parallel to the track between the outer door and template doors and the track to prevent ballast stones from falling on the rails or damaging the regulator itself during operational speeds in the range of 10-25 mph. Both the template door assembly and the inner door are typically mounted upon a boom which is pivotally joined to the regulator machine and is held in operational position by at least one fluid-powered cylinder.

Conventional ballast regulator wings are often provided with removable blades mounted along their lower edges, which are subject to the most rigorous exposure to the rail ballast. Conventional blades are fastened to the wing using threaded fasteners such as nuts and bolts. These fasteners are often worn during the regulating operation, since the ballast is very abrasive. Such blades require replacement since the blades themselves are subject to the same abrasive forces. Thus, replacing the blades is a tedious operation. Also, since the blades are often relatively heavy and elongate in shape, they are difficult to remove single-handedly by railway maintenance personnel.

Thus, there is a need for a rail regulator blade which is more readily replaced on the regulator wing.

SUMMARY

The above-identified need is met by the present segmented railway regulator blade, which is provided in relatively shorter segments, each individually mounted to the regulator wing. In this manner, the bulk and weight of conventional blades are overcome, allowing single-handed replacement by railroad maintenance personnel. Also, since each segment of the present blade only extends along a portion of the wing, only blade portions actually requiring replacement need to be removed. Thus, there is less waste of material when using the present blades.

In addition, the present blades have irregular side edges each configured for tightly and positively engaging adjacent segments. This positive engagement is achieved in one embodiment by an alternating laterally extending lug and recess configuration. The lug is received in a corresponding recess of an adjacent segment, and the recess receives the laterally extending lug of the adjacent segment. The irregular edges are dimensioned so that there is a tight fit between adjacent segments that prevents vertical misalignment of the segments on the wing. In addition, the tight engagement of the segments prevents stray ballast particles from becoming lodged in the gap between the segments. Ballast particles have been known to cause misalignment and breakage of conventional blade components, due in part to crevices or clearances created by conventional regulator blades, and also by the speed at which regulators travel along the track.

Another feature of the present regulator blades is that they are reversible upon the wing, thus providing two wear surfaces to the user. Also, the irregular edge surfaces are configured to maintain the positive engagement with the adjacent blade segment, even if only one segment is inverted. The present blade segments are optionally provided with wear-resistant hard facing to reduce abrasive wear, and the facing is deposited along upper and lower edges. Thus, by inverting the segment, a worn edge is replaceable with an unworn edge, provided that the segment had not been previously inverted.

More specifically, a blade segment is provided for use on a railway regulator wing, and includes a blade body having a front surface, a top surface, a bottom surface, a first side edge and a second side edge, the blade body having at least one mounting aperture. Each of the first and second side edges has an irregular surface configuration such that adjacent segments tightly and nestingly engage each other along complementary side edges as they are mounted upon the railway regulator wing.

In another embodiment, a replacement blade for a railway regulator wing is provided, the blade includes a plurality of blade segments mountable adjacent each other along a longitudinal axis of the wing, each segment having a body with a blade body having a front surface, a top surface, a bottom surface, a first side edge and a second side edge. Each blade body has at least one mounting aperture, and each of the first and second side edges has an irregular surface configuration such that adjacent segments tightly and nestingly engage each other along complementary side edges as they are mounted upon a railway regulator wing. In addition, each side edge has a lug extending laterally beyond the edge and a recess extending inwardly from the edge.

DETAILED DESCRIPTION

Figure 1:
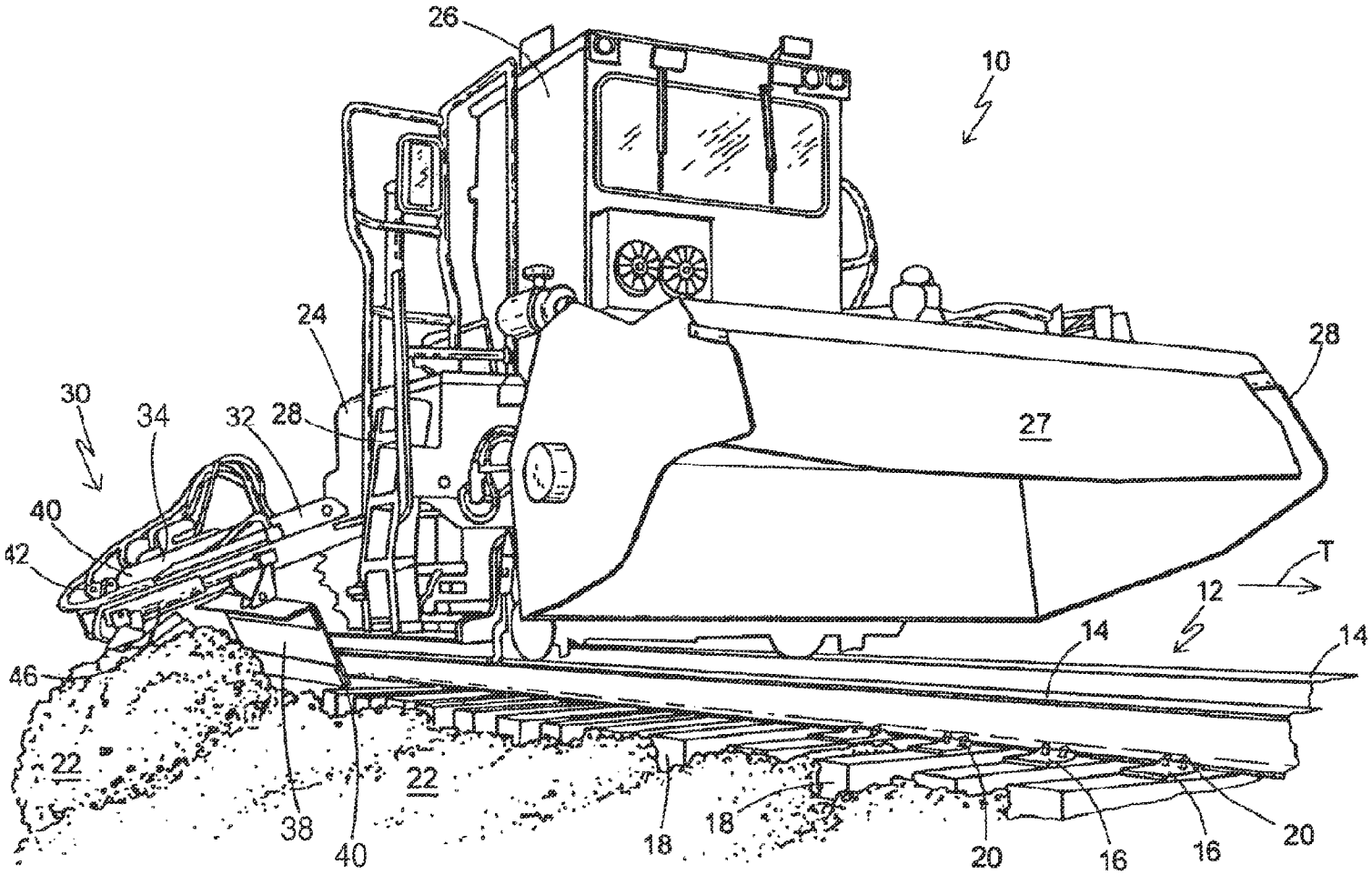
FIG. 1 is a rear perspective view of a self-propelled railway regulator machine equipped with the present segmented blade.

Referring now to FIG. 1, a railroad ballast regulator, generally designated 10, is shown disposed on a railroad track 12 having a pair of rails 14 mounted on tie plates 16 which are attached to typically wooden ties 18 by fasteners 20 such as rail spikes, lag screws or the like. The ties 18 are supported by particulate ballast 22, which is typically made of crushed rock.

The regulator 10 is preferably self-propelled through a power source 24 such as a diesel engine, but it is also contemplated that the machine could be towed along the track 12. An operator's cab 26 includes a control panel and other operator inputs (not shown) which are used to control the movement of the regulator 10 along the track 12, as well as the ballast regulating functions which will be described below. A broom 27 is preferably disposed at a rear of the regulator 10 for sweeping stray ballast 22 from the tops of the ties 18. Each of two sides 28 of the regulator 10 is preferably provided with a rail ballast wing assembly, generally designated 30, for regulating or shaping the ballast 22 on that side of the track 12, although a regulator with one wing assembly 30 is contemplated. Since both wing assemblies 30 are substantially identical, only one will be described below.

The rail ballast wing assembly 30 includes a main support boom 32 operating about a transverse pivot axis. The boom 32 is pivotally secured to the side 28 of the regulator 10 so that the elevation of the boom relative to the regulator may be adjusted. As is known in the art, a fluid power cylinder 34 secured to an outer end 36 of the boom 32 regulates the degree of pivoting/angle of elevation of the boom 32. As is seen in FIG. 1, a preferred angle of elevation is approximately 110-140 degrees from vertical, so that a desired angle of slope of the ballast 22 is obtained. The angular orientation may vary to suit the application.

In the present application, it is to be understood that the regulator 10 may operate in either forward or reverse directions on the track 12. For clarity, the terms "front" and "rear" will refer to the orientation of the following components when the regulator 10 travels in the direction of the arrow "T" in FIG. 1. Also, each regulator wing assembly 30 includes at least one wing 38 equipped with the present replaceable segmented blade 40. As seen, the blade 40 is mounted along a lower edge 42 of the wing 38 (best seen in FIG. 5), as is known in the art. This is the region of the wing 38 that is exposed to the most ballast-generated erosion.

Figure 2:
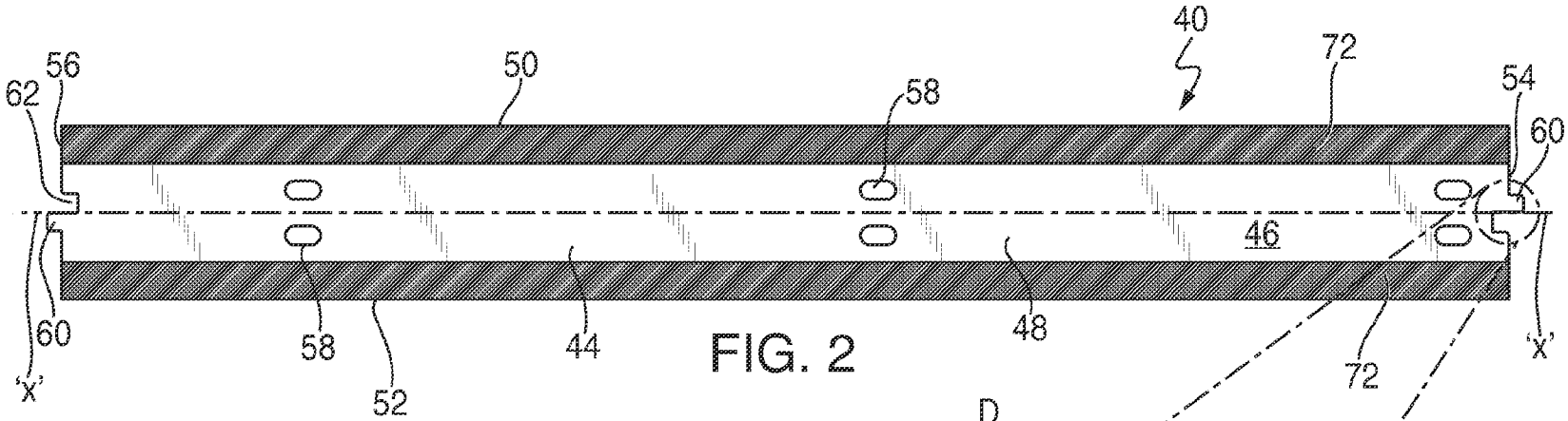
FIG. 2 is a front view of a blade segment of the present regulator blade shown mounted to a regulator wing.
Figure 4:
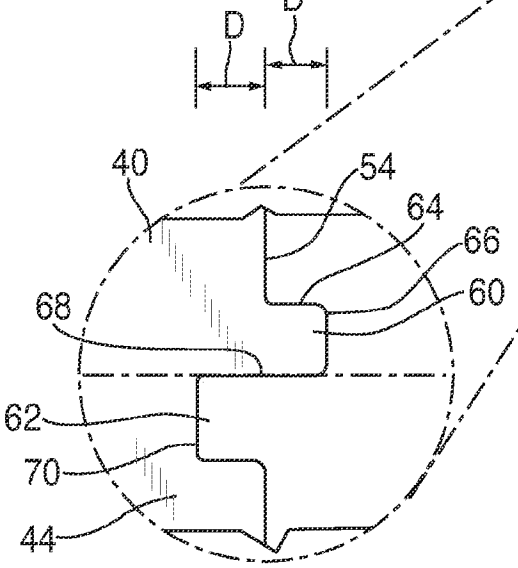
FIG. 4 is an enlarged fragmentary front elevation of the blade of FIG. 1.
Figure 3:
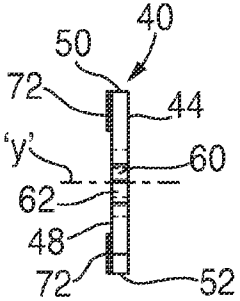
FIG. 3 is a side or end view of the segment of FIG. 2.

Referring now to FIGS. 2-4, the present regulator blade 40 features a segmented construction in which adjacent segments are closely fitted to each other using an irregular side edge surface construction. The irregular surface construction enhances the nesting of adjacent segments, and prevents relative vertical movement of adjacent segments. In addition, the segments are constructed and arranged so that a relatively small clearance is created in the nested adjacent irregular edges once they are mounted to the wing 38. In this manner, stray ballast particles are prevented from becoming lodged between the segments as the regulator 10 travels along the track 12 during operation.

More specifically, a blade segment 44 is provided for use on a railway regulator wing 38 and includes a blade body 46 having a front surface, 48 a top surface 50, a bottom surface 52, a first side edge 54 and a second side edge 56. It will be understood that the top and bottom surfaces 50, 52 are interchangeable depending on the orientation of the segment 44 on the wing 38, and also that the first and second side edges 54, 56 are also similarly interchangeable depending on the orientation of the segment 44. In addition, the blade body 46 has at least one mounting aperture 58. In the preferred embodiment, there are vertically spaced pairs of apertures 58, the pairs being spaced along a longitudinal axis "X" of the segment 44.

A significant feature of the present segment 44 is that each of the side edges 54, 56 have an irregular surface configuration constructed and arranged such that adjacent segments tightly and nestingly engage each other along complementary side edges as they are mounted upon the railway regulator wing 38. As best seen in FIGS. 2 and 4, the irregular configuration on each side edge 54, 56 includes a lug 60 extending beyond the edge, and a recess 62 extending inwardly from the edge in the opposite direction from the lug. In addition the lug 60 is located vertically adjacent the recess 62. Included on the lug 60 are a first lug surface 64, a second lug surface 66 extending normally to the surface 64, and a third lug surface 68 being in vertically spaced, parallel orientation to the first lug surface 64. Radiused corners connecting each of the surfaces 64, 66, 68 facilitate sliding reciprocal engagement of adjacent segments during installation and replacement. It will be seen that the third lug surface 68 is shared between the lug 60 and the recess 62.

As seen in FIGS. 2 and 4, when viewing the front surface 48 of the segment 44 in one orientation, the first side edge 54 has the lug 60 located vertically above the recess 62, and the second edge 56 has the lug located vertically below the recess. Also, a recess end 70 is linearly displaced from the corresponding side edge 54, 56 the same distance "D" as the second lug surface 66, in the opposite direction. While other distances "D" are contemplated, in one embodiment, the lug 60 and the recess 62 each extend approximately in the range of 0.4-0.6 inch from the corresponding edge 54, 56. In addition, in one embodiment, the recess end 70 extends approximately 0.6 to 0.8 inch.

Another feature of the present segment 44 is that the arrangement of the lug 60 and the recess 62 on the first side edge 54 is vertically opposite that of the lug and the recess on the second side edge 56. Thus, the segment 44 is rotatable about an axis "Y" (FIG. 3) transverse to the axis "X" and is still nestingly engageable with adjacent segments.

Referring now to FIGS. 5-8, various mounting arrangements are shown for the present segment 44 as it is mounted upon a wing 38. The number of the segments 44 attached to a wing 38 will depend on the length of the wing. Also, the length of each segment 44 along the longitudinal axis "X" will vary to suit the application. In some cases, a larger number of shorter segments 44 is preferred over a reduced number of relatively longer segments.

Figure 5:
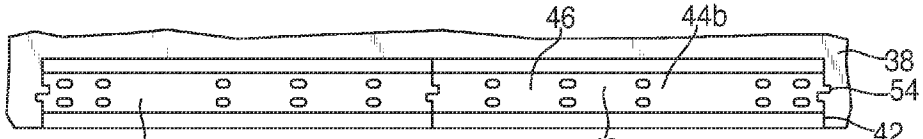
FIG. 5 is a front view of a pair of the present segments joined together on a regulator wing, shown fragmentarily.
Figure 6:
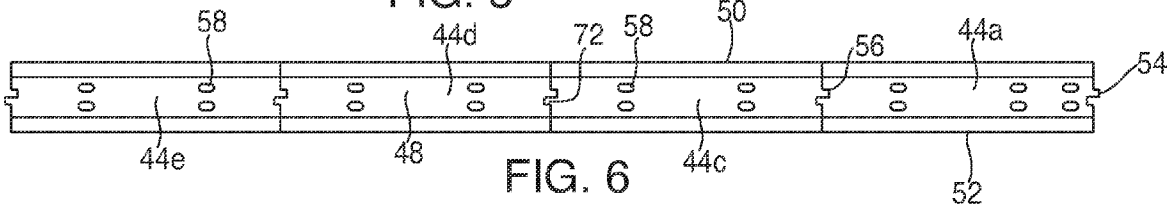
FIG. 6 is a front view of four of the present segments joined together.
Figure 7:
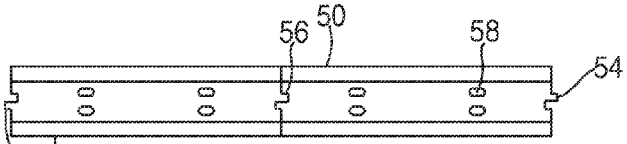
FIG. 7 is a front view of a pair of alternate embodiments of the present segments joined together.
Figure 8:
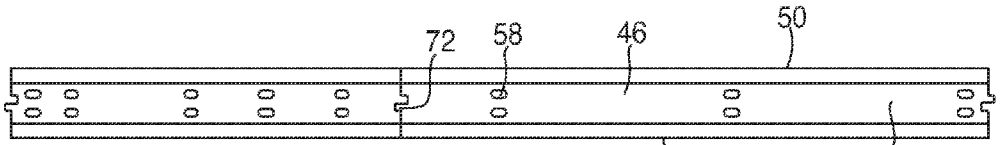
FIG. 8 is a front view of a pair of another alternate embodiment of the present segments joined together, such that each of the segments is configured differently from the other.
Figure 9:
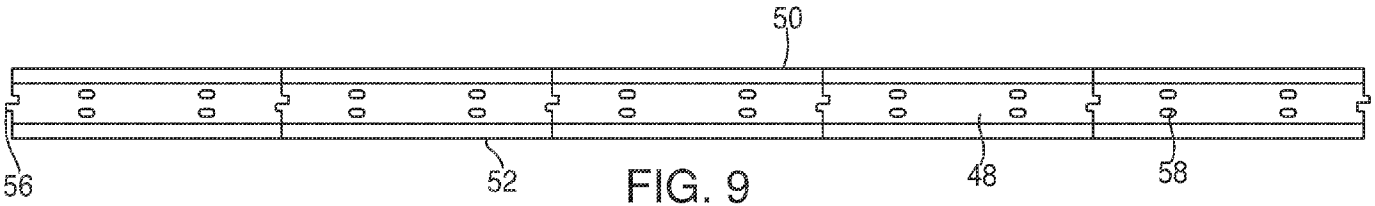
FIG. 9 is a front view of five segments joined together, with the segments having the configuration shown in FIG. 6.

Also, as seen in FIGS. 5 and 6, the vertical pairs of mounting apertures 58 are evenly spaced along the axis "X" in the segment 44*a* in FIG. 6, however the pairs are unevenly spaced along the axis in the segment 44*b* in FIG. 5. It is contemplated that this axial spacing may vary to suit the situation. Another feature of the present segment 44 is that a coating of hard facing 72 is deposited along at least one of the top and bottom surfaces 50, 52. It is preferred that both surfaces 50, 52 have the hard facing 72 so that once the segment 44 is reversed, a worn surface can be replaced with a relatively new surface, thus extending the working life of the segment.

Referring again to FIG. 6, a plurality of the blade segments 44*a*, 44*c*, 44*d*, and 44*e* are shown mounted adjacent each other along a longitudinal axis of the wing, 38. Each segment 44 has the body 46 as described above, and each blade body has at least one mounting aperture 58; as well as the lug 60 and recess 62 structure of FIGS. 2 and 4. In the assembly of FIG. 6, the lug 60 and the recess 62 each extend approximately in the range of 0.4-0.6 inch from the corresponding side edge 54, 56, and a gap 72 is defined between adjacent segments in the range of 0.003 inch. It is contemplated that the size of the gap 72 may vary to suit the application, as long as the gap is relatively small to prevent ballast particles from becoming trapped between adjacent segments 44.

While particular embodiments of the present segmented rail regulator blade has been shown and described, it will be appreciated by those skilled in the art that changes and modifications may be made thereto without departing from the invention in its broader aspects and as set forth in the following claims.

What is claimed:

1. A blade segment for use on a railway regulator wing, comprising:

a blade body having a front surface, a top surface, a bottom surface, a first side edge and a second side edge;

said blade body having at least one mounting aperture; and each of said first and second side edges having an irregular configuration such that adjacent segments tightly and nestingly engage each other along complementary side edges as the adjacent blade segments are mounted upon a railway regulator wing, said irregular configuration on each said edge including a lug extending beyond said edge and a recess extending inwardly from said edge, said lug being located vertically adjacent said recess and located at one side relative to a longitudinal axis of said blade body, said recess being located at an opposite side relative to the longitudinal axis, such that a common surface shared by said lug and said recess is positioned along the longitudinal axis.

2. The blade segment of claim 1, further including a hard facing coating on at least one of said top surface and said bottom surface.

3. The blade segment of claim 1, wherein when viewing said front surface of said segment in one orientation, said first edge has said lug located above said recess, and said second edge has said lug located below said recess.

4. The blade segment of claim 1 wherein said lug extends from said edge the same distance that said recess extends inwardly from said edge.

5. The blade segment of claim 4, wherein said lug and said recess each extend approximately in the range of 0.4-0.6 inch from said side edge.

6. The blade segment of claim 1, wherein said at least one mounting aperture includes pairs of vertically spaced apertures located along a longitudinal axis of said body.

7. The blade segment of claim 6, wherein said pairs of vertically spaced mounting apertures are located in irregular spacing along the longitudinal axis of said body.

8. A replacement blade for a railway regulator wing, said blade comprising:

a plurality of blade segments mountable adjacent each other along a longitudinal axis of the wing, each said segment having a body with a blade body having a front surface, a top surface, a bottom surface, a first side edge and a second side edge;

each said blade body having at least one mounting aperture; and each of said first and second side edges having an irregular configuration such that said adjacent segments tightly and nestingly engage each other along complementary side edges as the adjacent blade segments are mounted upon a railway regulator wing; and each said side edge having a lug extending laterally beyond said edge and a recess extending inwardly from said edge, said lug having a first lug surface, a second lug surface extending normally relative to the first lug surface, and a third lug surface being in spaced, parallel orientation to said first lug surface.

9. The replacement blade of claim 8, wherein each said blade body has said lug located vertically above said recess on one said side edge, and said lug located vertically below said recess on the other said side edge.

10. The replacement blade of claim 8, wherein each of said blade segments is individually replaceable and is rotatable relative to the wing about an axis transverse to the longitudinal axis of said blade, such that inversion of one segment maintains the nesting relationship of adjacent blade body side edges.

11. The blade segment of claim 8 wherein said lug extends from said edge the same distance that said recess extends inwardly from said edge.

12. The blade segment of claim 11, wherein said lug and said recess each extend approximately in the range of 0.4-0.6 inch from said side edge and a gap is defined between adjacent segments in the range of 0.003 inch.

* * * * *